United States Patent [19]

Giordano

[11] 3,971,087

[45] July 27, 1976

[54] APPARATUS FOR APPLYING A SOLE TO AN UPPER IN THE MANUFACTURE OF SHOES

[75] Inventor: Antonio Giordano, Florence, Italy

[73] Assignee: Viges S.p.A., Vigevano (Pavia), Italy

[22] Filed: Nov. 11, 1974

[21] Appl. No.: 522,830

[30] Foreign Application Priority Data

Nov. 22, 1973 Italy ..... 31642/73

[52] U.S. Cl. ..... 12/1 A; 12/33.6

[51] Int. Cl.[2] ..... A43D 89/00

[58] Field of Search ..... 12/1 R, 1 A, 33, 33.6, 12/36.5, 17 R, 1 W

[56] References Cited

UNITED STATES PATENTS

| | | | |
|---|---|---|---|
| 2,443,877 | 6/1948 | Vacin | 12/1 R |
| 2,445,848 | 7/1948 | Finn | 12/33.6 |
| 3,107,376 | 10/1963 | Reid et al. | 12/1 R |
| 3,608,118 | 9/1971 | Rex et al. | 12/1 A |

*Primary Examiner*—Patrick D. Lawson

*Attorney, Agent, or Firm*—Pollock, Vande Sande & Priddy

[57] ABSTRACT

An apparatus for applying a sole to an upper in the manufacture of shoes, comprising in combination: a seat for a sole, a shoe last destined to receive an upper completed with insole, a means for lifting and for transporting the sole, said means being capable of controlled reciprocation between said seat and said shoe last, and guide means cooperating with the latter in order to guide the sole to a position centered on the upper.

5 Claims, 9 Drawing Figures

APPARATUS FOR APPLYING A SOLE TO AN UPPER IN THE MANUFACTURE OF SHOES

The present invention relates to an apparatus for applying mechanically, and in a predetermined position, soles to uppers in the manufacture of shoes.

To date, this operation has been carried out manually by highly specialized operators. The upper, complete with insole is first mounted on a suitable shoe last, and a quick setting cement is smeared on its edge. Finally, the operator applies the sole to the upper carefully centered with respect thereto.

The manual operation of applying the sole to the upper is relatively long and difficult, and for the mutual centering of the two parts it is necessary to rely exclusively on the skill of the operator.

The present invention comprises an apparatus capable of carrying out this operation mechanically in a quick and precise manner so that the mutual centering of the upper with respect to the sole will always be perfect, whatever the form and size of the parts.

For this purpose, according to the invention, there is provided of an apparatus comprising in combination: a seat for a sole, a shoe last destined to receive an upper complete with its insole, a lifting and transporting means for the sole which can be controlled to reciprocate between said seat and said shoe last, and guide means copperating with said shoe last in order to guide the sole to a centered position with respect to the upper.

In one preferred practical embodiment of this invention, the lifting and transporting means for the sole consists of a suction device mounted at the free end of the stem of the piston of a first pneumatic or hydraulic double acting piston. This first cylinder is mounted in vertical position, at the free end of the stem of a piston of a second pneumatic or hydraulic double acting piston horizontally mounted on a suitable frame.

The sole guiding means as aforesaid consists of two groups of edge members mounted for interaction with the toe and the heel of the shoe last, respectively, and for movement toward or away from said shoe last.

The movement of these edge members, which diverge in an upward direction can be suitably controlled by means of the associated double acting pneumatic or hydraulic cylinders.

Several seats for soles, and several shoe lasts carrying the uppers can be advantageously mounted on a conveyor which is caused to in a stepwise manner in correspondence with said sole lifting and transporting means.

The structural and functional characteristics of this invention, and its advantages with respect to the known art, will clearly appear from the following description of one practical embodiment made with reference to the attached drawings, wherein.

Figure 1:
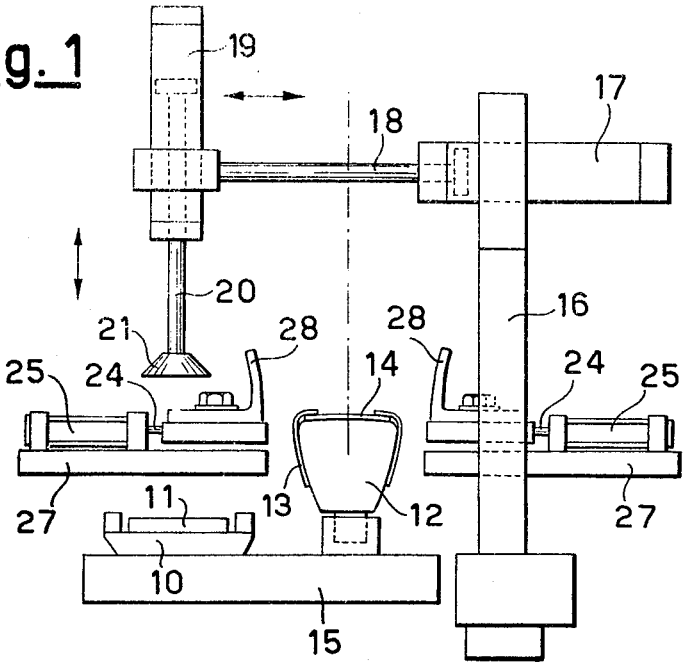
FIGS. 1 and 2 are two elevational views of the apparatus in different operative positions.
Figure 2:
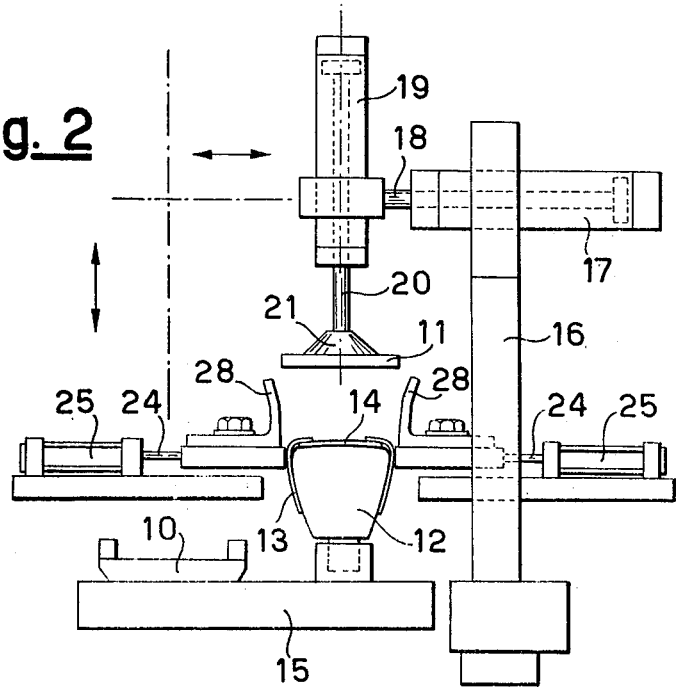

With reference first to FIGS. 1 and 2 of the drawings the numeral 10 denotes a seat for a sole 11, and 12 denotes a removable shoe last carrying an upper 13 already completed with the insole 14. The seat 10 and the shoe last 12 are mounted on a base 15 which can be either stationary or movable in stepwise fashion as will be described later on.

A frame 16 carries a horizontally disposed double acting cylinder 17. The stem 18 of the piston of cylinder 17 carries at its free end a second, vertically disposed double acting cylinder 19, vertically located; the stem 20 of the piston of cylinder 19 is provided at its free end with a suction cup 21 the suction of which can be controlled.

Figure 3:
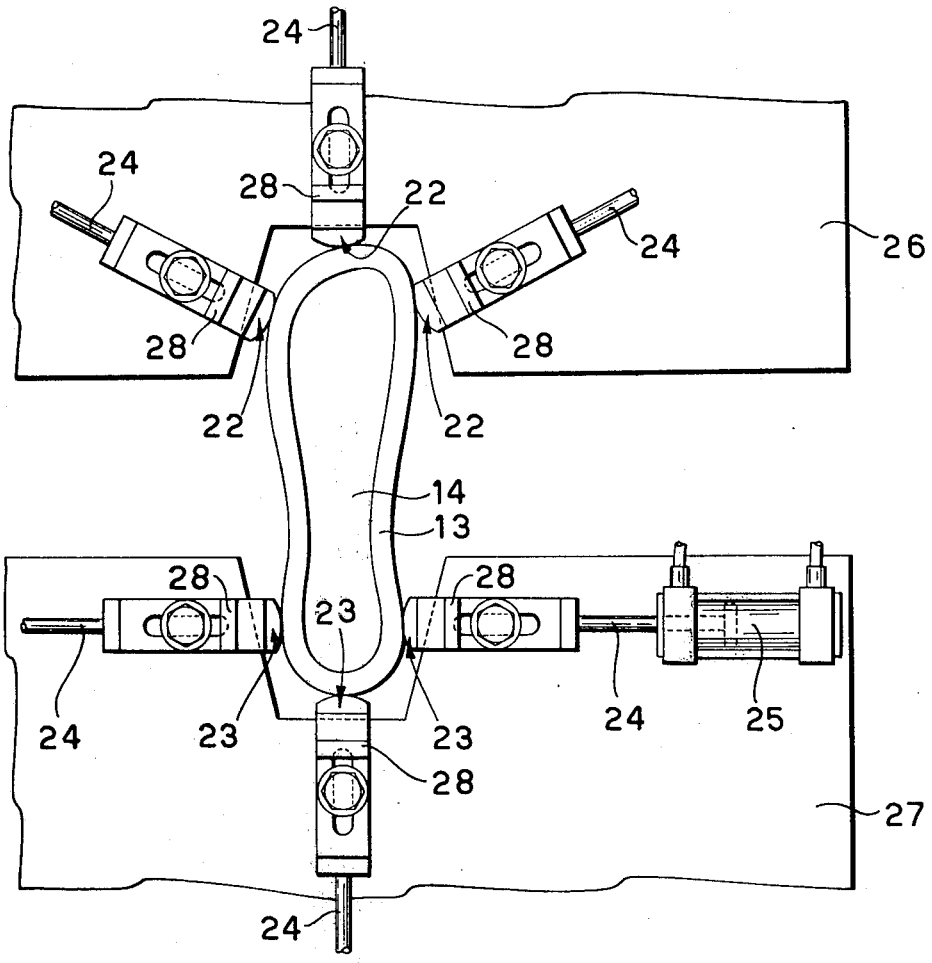
FIG. 3 is a plan view of the upper carrying shoe last with the guide means for the sole.
Figure 4:
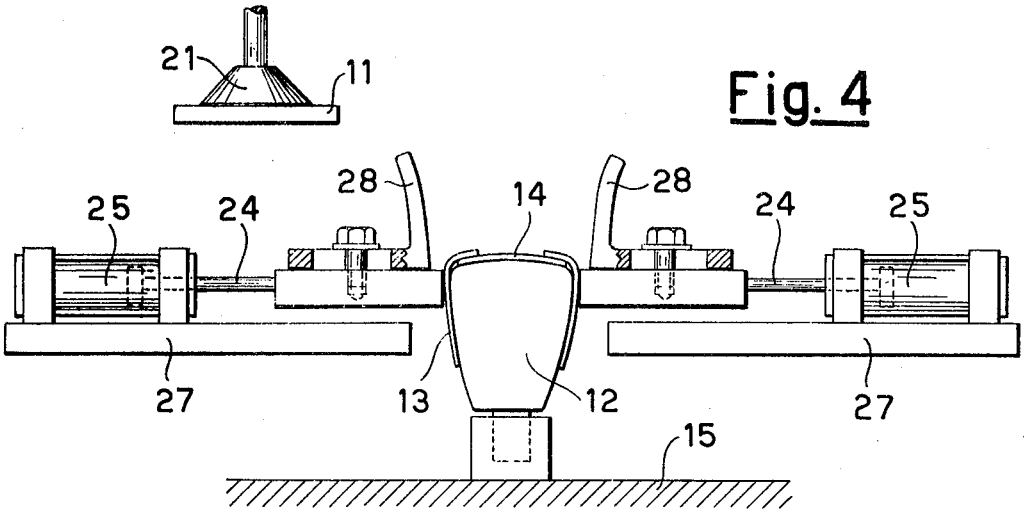
FIGS. 4 to 6 show operative stages of the apparatus.
Figure 5:
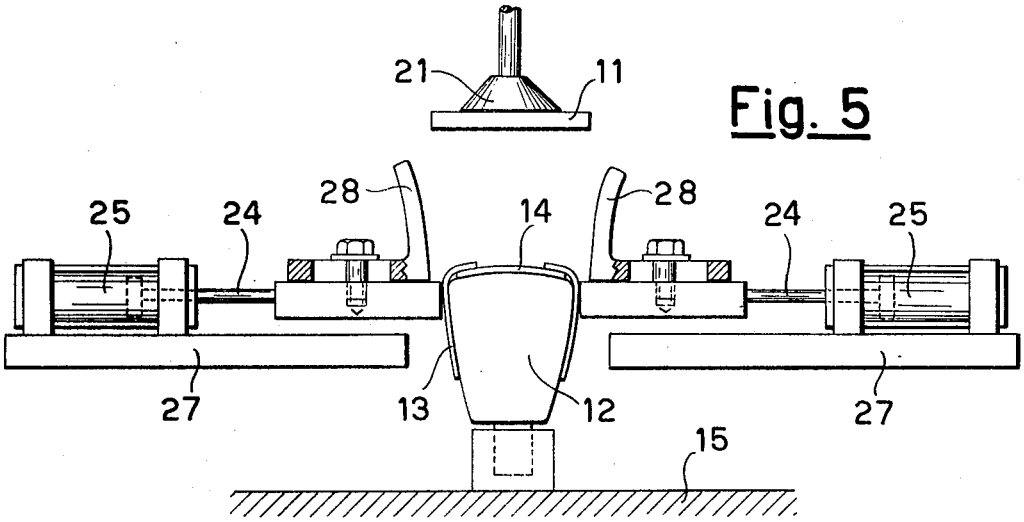
Figure 6:
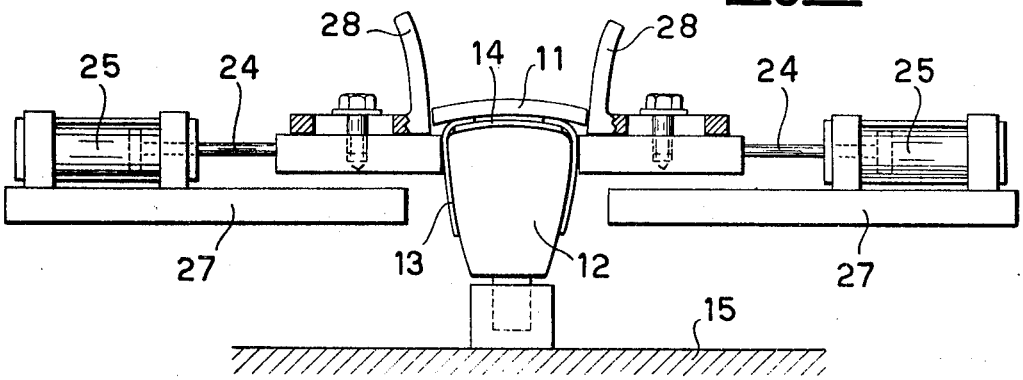

Cooperating with last 12 are means for guiding the sole, in the form of two groups of positioning devices 22, 23, interacting with the toe and the heel, sections of the sole respectively (FIG. 3). The positioning devices 22, 23 are mounted so that their positions can be adjusted (FIGS. 4 to 6) at the ends of the stems 24 of the respective double acting cylinders 25 carried by the associated support plates 26, 27 which can be either stationary or movable by means of suitable operative means.

Each positioning member 22, 23 has an inclined, upwardly extending edge portion 28 thus the faced edges 28 form a guide means for the exact centering of the sole on the shoe last with respect to the upper.

The operation of the above described apparatus is clearly shown in the drawings and occurs as follows:

Stem 20 is lowered so that its suction cup 21 picks up sole 11 previously located in seat 10. Stem 20 is then raised with sole 11 attached to the suction cup and stem 18 is moved to the position shown in FIG. 2 so that sole 11 will be located exactly above upper 13 previously mounted on the shoe last 12.

At this point the groups of positioning devices 22 and 23 are caused to approach shoe last 12, in the position shown in FIG. 3, so as to guide and hold the shoe last during application of sole 11 to upper 13.

The peripheral edge of upper 13 is smeared with a suitable quick setting cement and the vacuum is released from suction cup 21. This causes sole 11 to be placed onto shoe last 12, in perfectly centered position with respect thereto, due to the presence of edges 28 of the two groups of positioning devices. As clearly shown in the drawings, the positioning devices 22, 23 can be adjusted so as to allow the sole to extend out of the upper to a predetermined extent. The final fixing of the sole to the upper is accomplished by a suitable press not shown in the drawings. Alternatively the application of a sole or of a possible insole to the shoe last or to the upper can be accomplished by seaming instead of glueing, in which case an automatically operated seam-folding machine can be located above shoe last 12.

Figure 7:
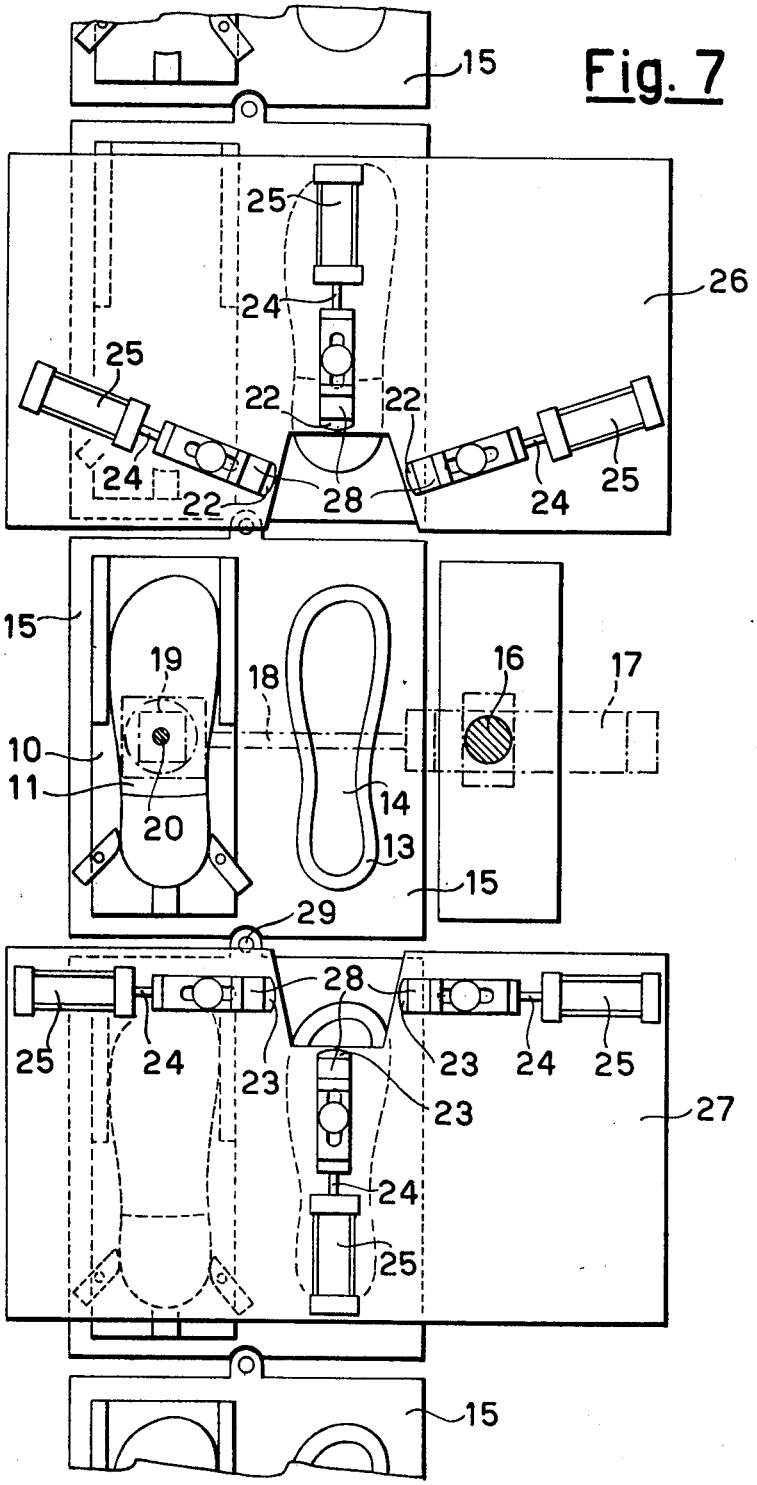
FIGS. 7 and 8 are plan views of two different operative stages of the apparatus according to the invention, where a plurality of seats for soles and a plurality of upper carrying shoe lasts are mounted on a conveyor.
Figure 8:
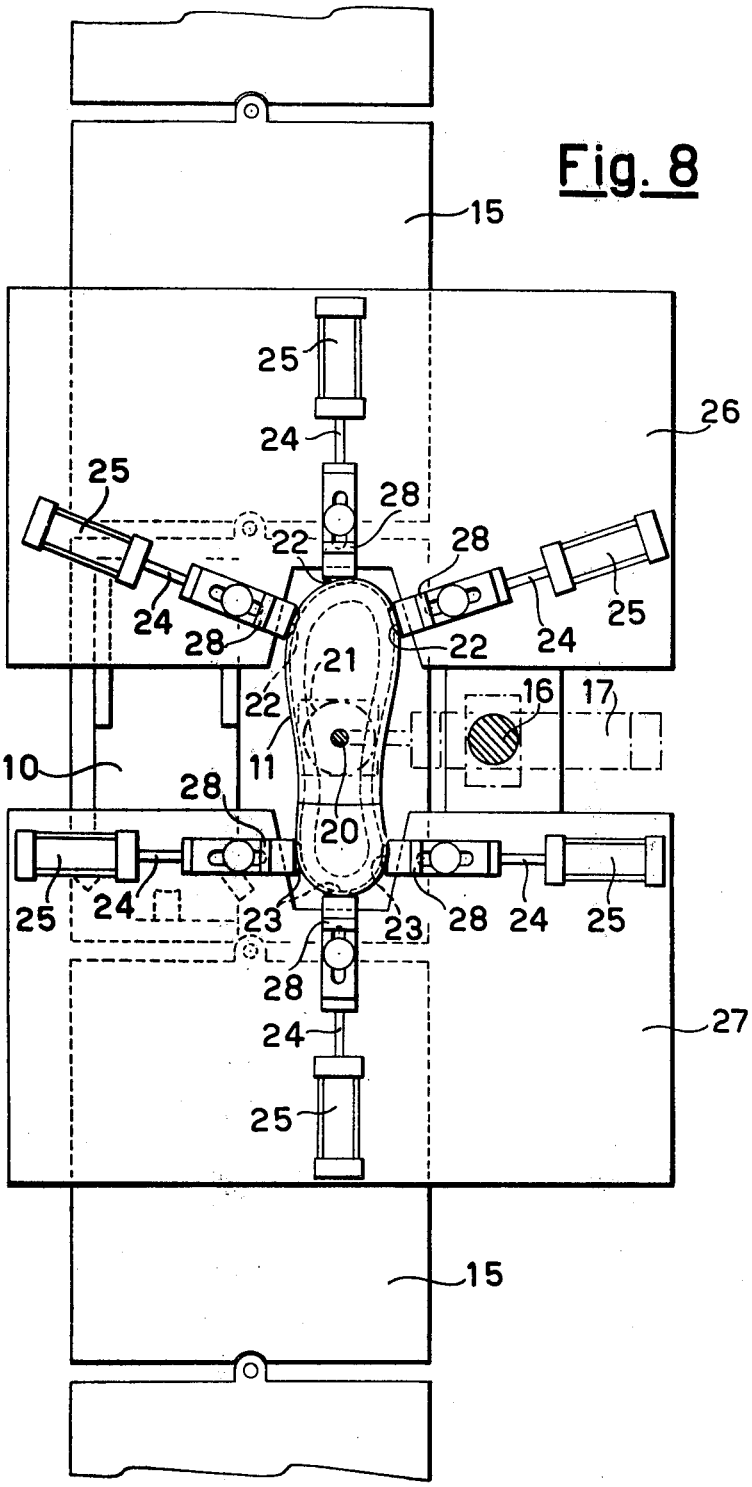
Figure 9:
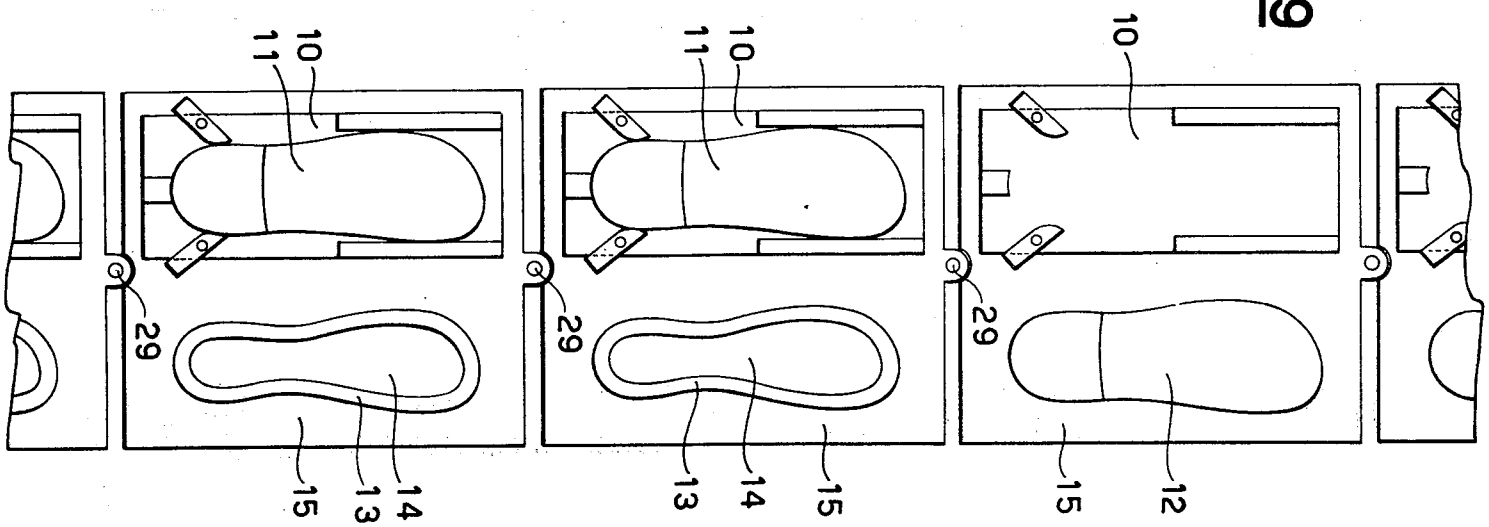
FIG. 9 is a plan view of said conveyor.

The apparatus according to this invention can be either stationary, or it can form part of a conveyor which is caused to advance stepwise as shown in FIGS. 7, 8 and 9.

These figures illustrate a plurality of seats 11 for the sole, and of shoe lasts 12, carried by the relative plates 13 articulately interconnected at 29 so as to form a conveyor. The seats and the shoe lasts are thus sequentially carried in correspondence with the apparatus so as to permit continuity of production.

Having described the present invention what is claimed is:

1. An apparatus for applying a sole to an upper in the manufacture of shoes, comprising in combination a seat for containing a sole, a shoe last adapted to receive an upper completed with insole, a first double-acting cylinder, a suction means mounted on the free end of the stem of a piston of said cylinder, for lifting and for transporting the sole, said suction means being capable of controlled reciprocation between said seat and said shoe last, and guide means cooperating with the shoe last to guide the sole to a position centered on the upper.

2. An apparatus as claimed in claim 1, including a second-double acting cylinder, wherein said first double-acting cylinder is vertically mounted at the free end of the piston stem of the said second double acting cylinder, the second double-acting cylinder being horizontally mounted on a frame.

3. An apparatus as claimed in claim 1, including a conveyor which can be caused to jog in correspondence with said means for lifting and for transporting the sole, and a plurality of sole seats and of upper carrying shoe lasts mounted on said conveyor.

4. An apparatus as claimed in claim 1, wherein the guide means for the sole consists of two groups of inclined edge elements mounted for engagement with the toe and the heel sections of the shoe last, respectively, and adapted for to-and-fro movement with respect to said shoe last.

5. An apparatus as claimed in claim 4, including positioning members which can be adjustably mounted at the free ends of the stems of the double acting cylinders, said edge members constituting parts of said positioning members.

* * * * *